United States Patent [19]

Nebon et al.

[11] 4,118,681

[45] Oct. 3, 1978

[54] HIGH-SPEED CURRENT-LIMITING DEVICE HAVING A CONTACT RECLOSING RETARDING MEMBER

[75] Inventors: Jean-Pierre Nebon, St. Martin-le-Vinoux; Robert Morel, Eybens, both of France

[73] Assignee: Merlin Gerin, Grenoble, France

[21] Appl. No.: 794,343

[22] Filed: May 6, 1977

[30] Foreign Application Priority Data

May 12, 1976 [FR] France ..... 76 14360
May 12, 1976 [FR] France ..... 76 14361

[51] Int. Cl.[2] ..... H01H 75/10
[52] U.S. Cl. ..... 335/195; 335/16; 335/174
[58] Field of Search ..... 335/16, 195, 14, 15, 335/147, 170, 174

[56] References Cited

U.S. PATENT DOCUMENTS

| | | | |
|---|---|---|---|
| 4,013,984 | 3/1977 | Wafer | 335/195X |
| 4,025,883 | 5/1977 | Slade et al. | 335/16 |

FOREIGN PATENT DOCUMENTS

| | | | |
|---|---|---|---|
| 1,286,184 | 1/1969 | Fed. Rep. of Germany | 335/195 |
| 721,451 | 3/1932 | France | 335/195 |
| 803,395 | 9/1936 | France | 335/195 |
| 1,413,241 | 8/1965 | France | 335/195 |

*Primary Examiner*—George Harris
*Attorney, Agent, or Firm*—Stevens, Davis, Miller & Mosher

[57] ABSTRACT

Current-limiting device having a movable contact vigorously moved in the open circuit position by an electromagnetic repulsion device at the appearance of a short-circuit current. A retarding member is mechanically linked to the movable contact to delay the reclosing of the contact and to prevent a reclosing before tripping of the circuit breaker.

8 Claims, 12 Drawing Figures

L

ℓ
48
32
t1
t2
t3
t4
t

L 48
32
t1
t2
t3
t4
t

L 48
32
t1
t2
t3
t4
t

HIGH-SPEED CURRENT-LIMITING DEVICE HAVING A CONTACT RECLOSING RETARDING MEMBER

This invention relates to a current-limiting device comprising a movable contact urged in the circuit closing position and high speed opening means of the movable contact that are energized by the current on the occurrence of a sudden rise and become inactive once the said rise in current has disappeared to allow automatic reclosing of the movable contact.

The U.S. Pat. Nos. 3,824,508 and 4,001,738 disclose a current-limiting device of this kind that can be built into an electric circuit breaker in order to rapidly move the movable contact into the opening position, independently of the tripping mechanism, or can be associated with the circuit breaker by being series connected with it in the circuit to be protected. The current-limiting device serves only to limit a short-circuit current, whereas the circuit breaker ensures the interrupt function. In this type of current-limiting device the movable contact moves rapidly and may return to the closed position before the circuit breaker has had time to act and to trip. To prevent reclosing on the short-circuit, latching the movable contact in the open position, or delaying closing of this contact, have already been proposed. Latching implies a manual operation for subsequent reclosing and a relatively long break in current supply. Known retarding means present the same disadvantage, and cannot ensure a time-lag independent of the value of the short-circuit. In a selective circuit, the lack of voltage for a relatively long time jeopardises continuous operation of equipment installed on branch lines unaffected by the fault and entails subsequent resetting of the various relays. This is a considerable handicap to the practical capabilities of the current-limiting device, and the object of the present invention is to solve this difficulty.

It is a further object of the invention to provide a retarding member which permits a contact reclosing after a predetermined laps of time, independent of the value of the rise in current.

The retarding member mainly comprises an inertia block able to effect a limited movement with respect to the movable contact and put into movement by the impact of the movable contact after an initial lost-motion of the contact. The time the movement of the inertia block lasts depends mainly on its mass and possibly on the stiffness of the return springs. The strength of the impact, which is a function of the short-circuit value, does not, in theory, influence the duration of the movement, and, consequently, the time after which the contact is released into the closed position. The time after which the contact returns to the closed position is chosen long enough for the fault suppressing circuit breakers to operate, and short enough to avoid absences of voltage triggering the release of the electromagnetic relays in a selective circuit.

These current limiting and current breaking functions may be combined in the same apparatus, the rapid opening movable contact being held in the open position by the operation of a tripping mechanism. The current limiting device may also be independent of the main circuit breaker and connected in series with it, as an improvement over the conventional safety fuses. Each pole of the limiting device has its own actuating means and its own retarding device.

These and other objects, features and advantages of the invention will be more fully understood upon reading of the following description of some embodiments of the invention, schematically shown in the accompanying drawings, in which.

Figure 1:
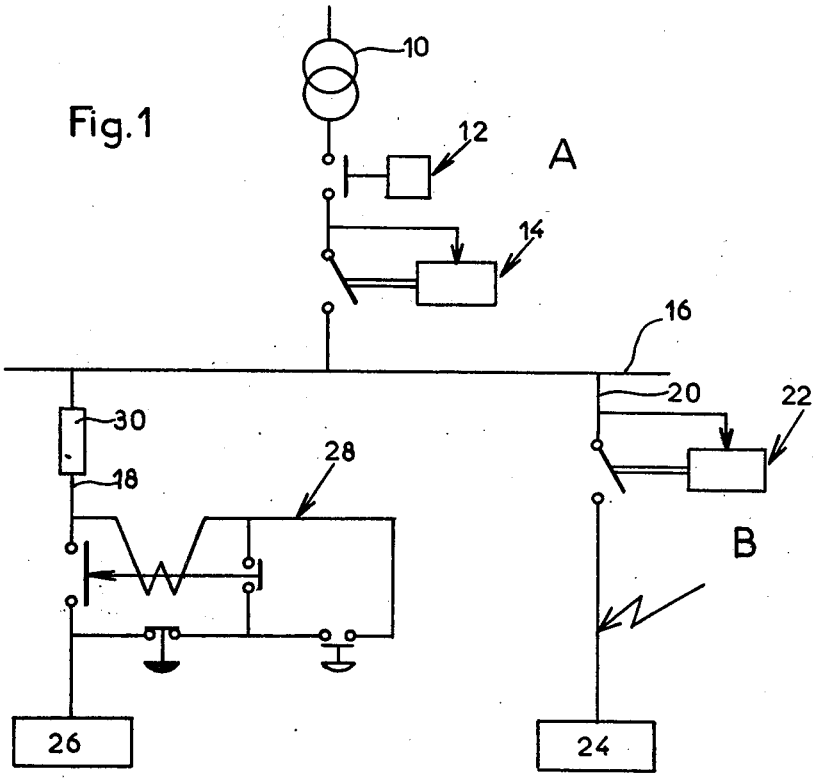
FIG. 1 shows the wiring diagram of an electrical installation provided with a current-limiting device, object of the invention.

In FIG. 1, an electrical installation with two levels, A and B, comprises a main transformer 10, and, downstream of the transformer, connected in series, a current-limiting device 12 and a main circuit breaker 14 connected to a distribution busbar 16, supplying two branch lines 18, 20. A circuit-breaker 22 at the head of the branch line 20 protects load 24, supplied by branch line 20. Branch line 18 supplies an electric motor 26 via a contactor 28 and a safety fuse 30. This circuit may of course have a greater number of branch lines and levels and circuit breaking is ensured selectively in the conventional manner so as to maintain supply to the sound lines in the installation should a fault appear on one of the branch lines, for instance on branch line 20, as shown in FIG. 1. The tripping mechanism of the main circuit breaker 14, ensures this selectivity by any suitable means, for instance by counting, and the current-limiting device 12 limits short-circuit current throughout the installation. When the fault occurs the contacts of current limiting device 12 open instantaneously to limit the short-circuit current, and it is obvious that in a selective circuit current-limiting device 12 must reclose, in order to ensure continuous current supply to the sound lines, once the fault has been eliminated by tripping of circuit breaker 22. Too rapid reclosing of the current-limiting device 12 before elimination of the fault will entail a re-opening and successive breaks of the short-circuit current; too slow reclosing will interrupt current supply long enough to release the electromagnetic relays and jeopardise continuous operation on the lines that remain sound.

Figure 2:
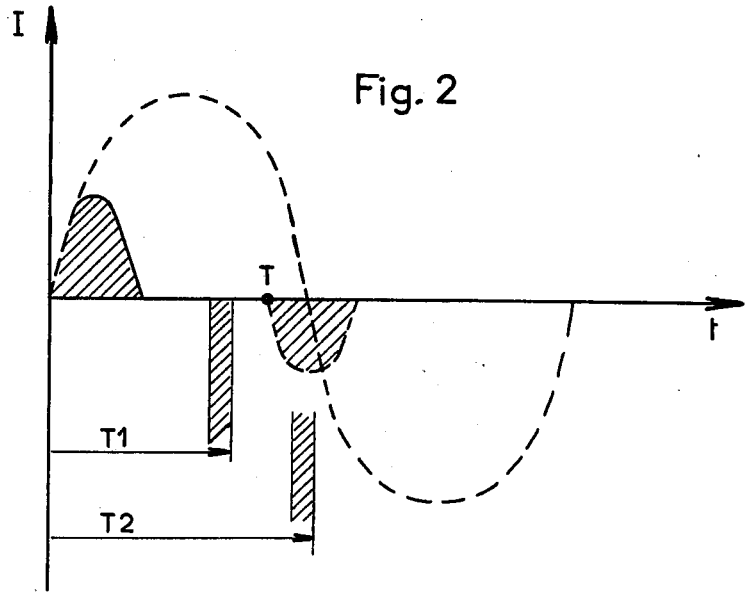
FIG. 2 shows the curves of current variation as a function of time.

FIG. 2 shows the time-current characteristic, the dashed line curve representing one cycle of a short-circuit current, and the continuous line curve the current limited by the action of current-limiting device 12. Points T1 and T2 represent respectively, the response time of the circuit breaker 22 and of the contactor 28.

It is clear that the reclosing of the contacts of the limiting device 12 before time T1, corresponding to the opening time of circuit breaker 22 placed on the fault line, will entail a new action on the part of current-limiting device 12. Reclosing of this limiting device after the time T2 will cause the contactor 28 to release and to interrupt the current supply to motor 26. Time T, of reclosing of current-limiting device 12 must fall between times T1 and T2, which occur at an interval of a few milliseconds.

Figure 3:
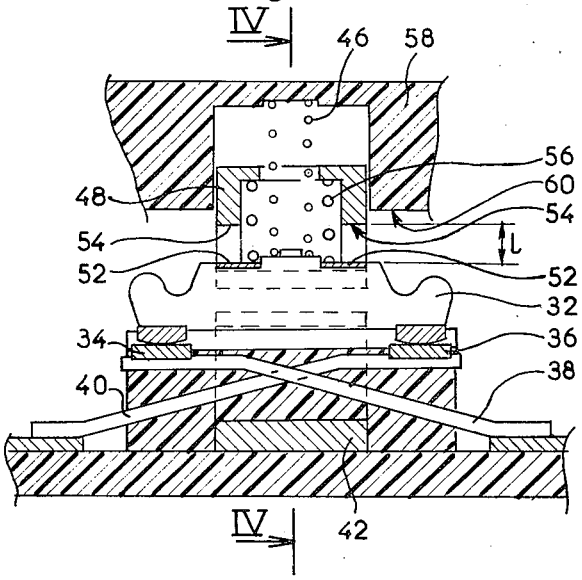
FIG. 3 is an axial section view of a current-limiting device, object of the invention.
Figure 4:
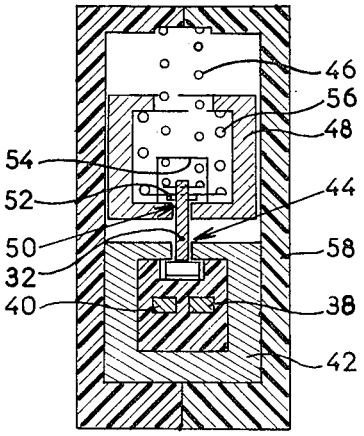
FIG. 4 is a section along the line IV—IV of FIG. 3.
Figure 6:
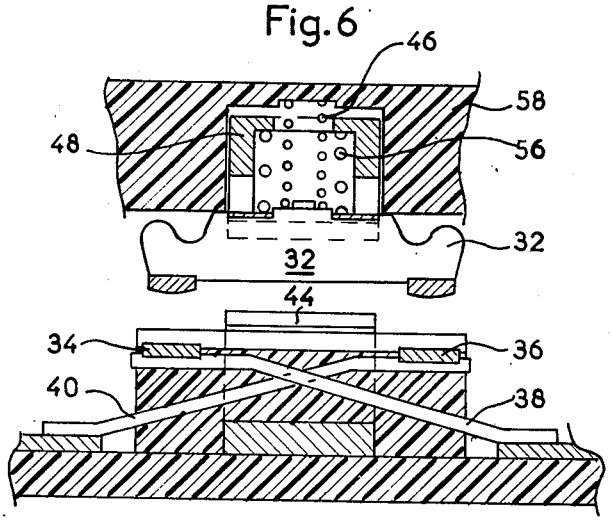
FIG. 6 is a similar view to that in FIG. 5, showing the movable contact in the fully open position.

FIGS. 3 and 6 show a pole of the limiting device 12 comprising a movable contact, arranged as a contact bridge 32, cooperating with a pair of fixed contacts 34, 36, connected to current-supply conductors 38, 40 which are crossed and traverse a duct-shaped magnetic circuit 42, having a square cross-section with an air gap 44 of small width. The lower part of contact bridge 32 equally of small width penetrates in air gap 44 in the closing position of contact bridge 32, and a spring 46 biases contact bridge 32 in the closed position. In case of a rapid rising of the current flowing through conductor 38, 40, the magnetic field created in air gap 44 induces secondary currents in contact bridge 32, and, as described in U.S. Pat. No. 4,001,738 mentioned earlier, produces the repulsion and rapid displacement of contact bridge 32 into the opening position.

According to the invention, contact bridge 32 is connected to an inertia block 48 able to move in the opening direction of contact bridge 32 and having a slot 50 into which the upper part of contact bridge 32 loosely fits. The relative displacement of contact bridge 32 with respect to inertia block 48 is limited on the one hand by ribs 52, preventing the contact bridge from withdrawing from slot 50, and on the other hand by the stop surfaces 54. A biasing spring 56, inserted between contact bridge 32 and the inertia block 48, urges these latter in a separate position limited by the ribs 52. The whole constitutes a link with a lost motion "1". Spring 46 ensures the contact pressure and biasing spring 56 which is weaker, maintains inertia block 48 away from contact bridge 32, to leave the latter a free motion "1" in the opening direction of the contacts.

The whole is housed in an enclosure 58, in insulating material, which guides inertia block 48 and has a stop surface 60 to limit the opening travel of contact bridge 32.

Figure 5:
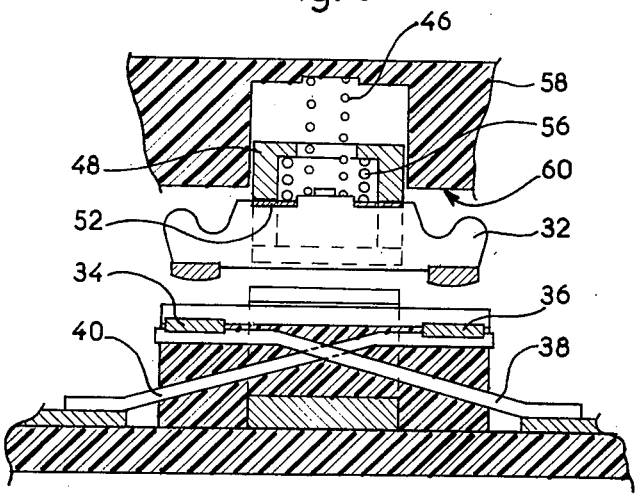
FIG. 5 is a similar view to that in FIG. 3, showing the movable contact in the intermediate opening position.

The current-limiting device according to the invention, operates in the following manner:

FIG. 3 represents the closing position of the limiting device 12, contact bridge 32 being held in the closed position by spring 46. When a fault current occurs, the electromagnetic forces due to this current flowing through the conductors 38, 40, expulse movable contact bridge 32 from air gap 44 in the opening direction of contacts 32, 34, 36. Low mass contact bridge 32 moves rapidly against the forces of springs 46 and 56, and covers the free motion "1", while the heavy mass inertia block 48 remains practically stationary. At the end of the free motion "1", shown on FIG. 5, contact bridge 32 is separated from fixed contacts 34, 36 by a distance sufficiently great to break the current, and inertia block 48 has not hindered or slowed down the movement of the movable contact bridge 32 during this first opening stage. Continuing its movement, contact bridge 32 hits inertia block 48 by coming into contact with surfaces 54, and puts inertia block 48 into movement, which hinders reclosing of the contact bridge in the manner described below with reference to FIGS. 7 to 9.

Figure 7:
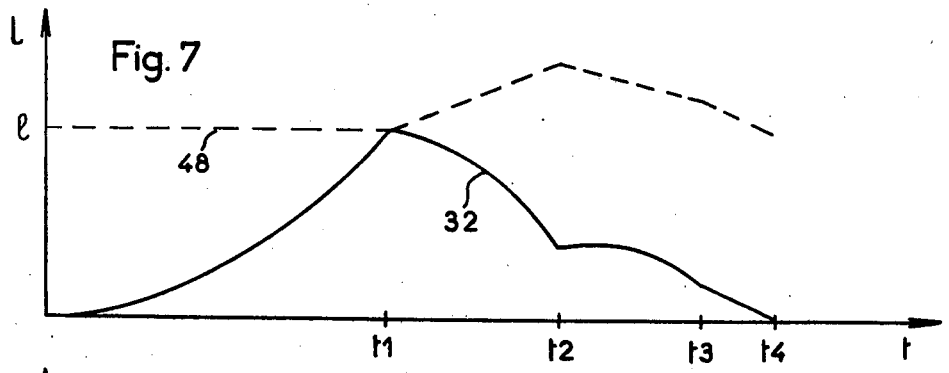
FIGS. 7 to 9 show various displacement curves of the movable contact and the corresponding inertia block for various short-circuit levels.

The full lines on FIG. 7 represent the movement of contact bridge 32 as a function of time, and the dashed lines the movement of inertia block 48, in the case of a relatively low short-circuit current. The impact between contact bridge 32 and inertia block 48 occurs at time *t*1, at which time inertia block 48 begins an oscillatory movement, whereas the contact bridge 32 is thrust by the impact in the closing direction. The contact bridge and inertia block moving in opposite directions, tend to become further apart, and at time *t*2, corresponding to a distance apart "1", limited by ribs 52, a return impact occurs reversing the direction of movement of inertia block 48. A second return impact occurs at time *t*3, and at the end of the displacement, contact bridge 32 and inertia block 48 move together until at time *t*4 they are in the initial closing position, shown on FIG. 3. Contact bridge 32 does not reach the stop position, shown on FIG. 6, and inertia block 48 carries out a to-and-fro movement including a number of successive impacts depending on the force of the impact transmitted to inertia block 48.

Figure 8:
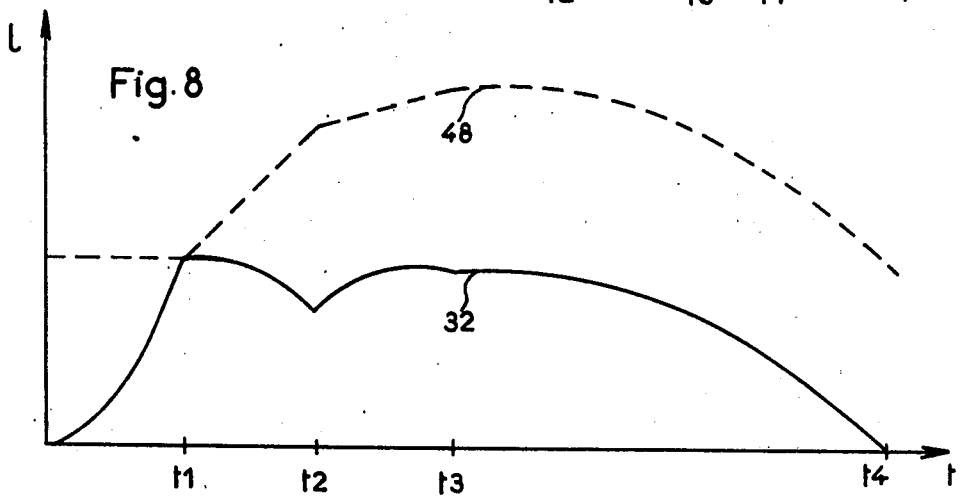
Figure 9:
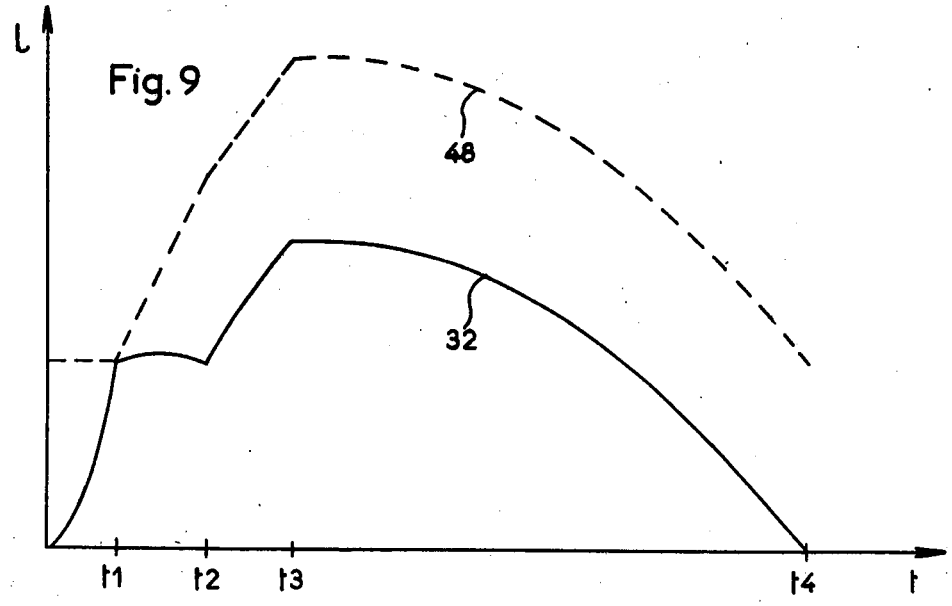

FIG. 8 shows the operation of the limiting device in the case of a higher short-circuit, but not high enough for contact bridge 32 to come up against the stop 60. The reclosing time of contact bridge 32, occurring at time *t*4, is approximately equal to that corresponding to the operation shown on FIG. 7. When a very high short-circuit occurs, shown on FIG. 9, the opening travel of contact bridge 32 is limited by stop 60 at time *t*3. After a series of impacts, the number of which depends on the value of the short circuit current, contact bridge 32 closes and as shown on FIGS. 7 to 9, this reclosing is slowed down by the inertia of inertia block 48 so as to obtain a practically constant opening time of the contacts of limiting device 12, independent of the value of the short circuit. This time is adjusted by the appropriate choice of inertia block 48.

In the example shown on the figures, inertia block 48 is in the form of a piston capping contact bridge 32, and it is clear that the pressure of the gases due to heating from the arcs produced between contacts 32, 34, 36 act in the opening direction and contribute to the movement of inertia block 48 of contact 32. It is possible to dispose another inertia block upon the inertia block 48 or to subdivide the latter in two or three elements to increase the series of impacts and enhance the retarding effect.

The displacement of contact bridge 32 may of course be produced by displacement means of the type described in the aforementioned U.S. Pat. No. 3,824,508, or by conventional electrodynamic effects. The mechanical link between contact bridge 32 and inertia block 48 may be designed differently, and a tripping mechanism, for instance of the kind described in this above mentioned patent may be associated with contact bridge 32 to perform the circuit breaking function.

Figure 10:
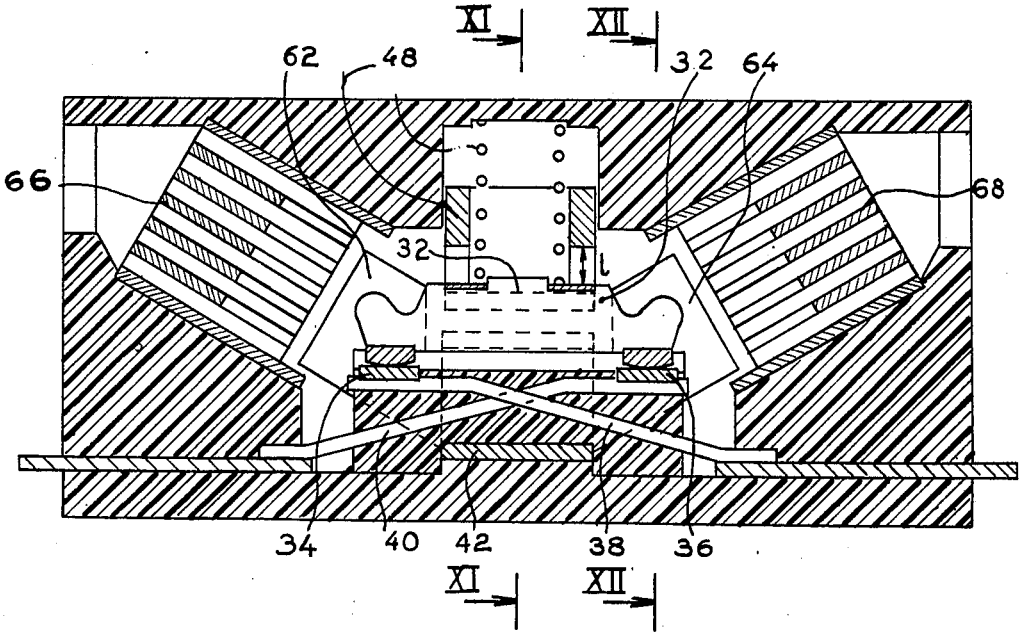
FIG. 10 is a view corresponding to FIG. 3 of an embodiment of the invention.
Figure 11:
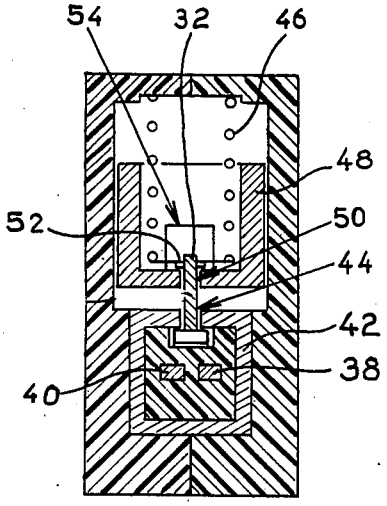
FIGS. 11 and 12 are sectional views taken respectively along the lines XI—XI and XII—XII of FIG. 10.
Figure 12:
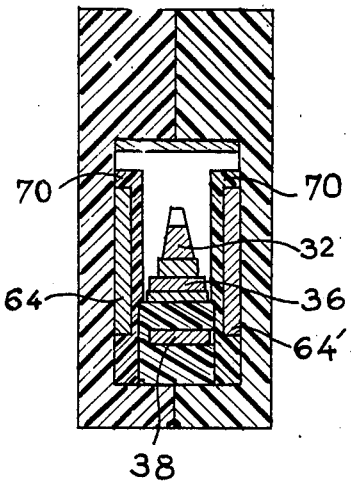

FIGS. 10 to 12 show an embodiment in which the magnetic circuit 42 carries two pairs of side flanges 62, 62'; 64, 64' which extend in the direction of arc chutes 66, 68 in such a manner that the arcs drawn between the contacts 32, 34, 36 extend in chambers defined between said side flanges 62, 62'; 64, 64'. It is easily seen that the side flanges constitute confronting pole faces and that the current flowing through the conductors 38, 40 produces a magnetic flux in the air gap between the pole faces 62, 62'; 64, 64' blowing the arcs drawn at the separation of contacts 32, 34, 36 towards the arc chutes 66, 68, to permit a rapid extinction of the arcs. The pole faces 62, 62'; 64, 64' are covered by a layer 70 of insulating material.

The inertia block 48 is advantageously of ferromagnetic material and constitutes a magnetic circuit having confronting pole faces defining a relatively small air gap or slot 50. In the closed-circuit position of the contact bridge 32 the latter extends in the air gap 50 and as soon as a short-circuit appears the contact bridge 32 is vigorously attracted towards the inertia block 48 as described in the above mentioned U.S. Pat. No. 3,824,508. This force increases the rapid opening of the contacts.

What is claimed is:

1. A current limiting device comprising a movable contact urged in the circuit closing position, electromagnetic means imparting under predetermined fault current conditions motion to the movable contact towards the circuit opening position and becoming inactive at the disappearance of said fault current conditions to allow self reclosing of the movable contact, a retarding member guided for translatory motion and of a predetermined mass, mechanically linked to said movable contact so as to permit a lost motion and an impact of the movable contact after this lost motion to move the retarding member and prevent a contact reclosing before said retarding member comes back to its original position.

2. A current limiting device according to claim 1, having spring means for urging said retarding member in said original position corresponding to the circuit closing position of said current limiting device.

3. A current limiting device according to claim 2, for an electric circuit comprising a circuit breaker said retarding member having a mass so predetermined as to prevent contact reclosing before tripping of said circuit breaker.

4. A current limiting device according to claim 3, said electromagnetic means comprising a magnetic circuit energized by the current flowing through said current limiting device and having closed spaced apart confronting pole faces defining therebetween adjacent said movable contact gap means and an elongated conducting induction plate means secured to said movable contact and extending between said pole faces in said gap means when said movable contact is in said circuit closing position so that the rising of said fault current causes the repulsion of said induction plate from said gap means and the motion of the movable contact towards said circuit opening position.

5. A current limiting device according to claim 2, having abutment means for limiting the movement of said retarding member.

6. A current limiting device according to claim 3, said retarding member being of ferromagnetic material and having a loop-shaped configuration surrounding said movable contact and having an air gap in which extends said movable contact in said circuit closing position.

7. A current limiting device having separable contacts and an electromagnetic repulsion device causing under predetermined fault-current conditions the separation of said contacts by imparting motion to a movable contact means of said contacts, said device comprising:

a magnetic circuit having closely spaced apart confronting pole faces defining a linearly extending air gap of small width therebetween, terminal conductor means supplying current to said current limiting device and linked with said magnetic circuit in magneticfield generating relation therewith, said movable contact means supporting an elongated conducting induction plate extending lengthwise between said pole faces in said air gap when said movable contact means is in closed-circuit position, in such a manner that an abrupt rising of said fault current and the resulting rising of the magnitude of the magnetic field generated in said air gap by said terminal conductor means induce in said induction plate a secondary current linking said magnetic field and tending to repel said induction plate from said air gap to cause said movable contact means to move away from said magnetic circuit, said magnetic circuit having further two confronting pole face plates surrounding said separable contacts so that the magnetic field generated in the space between said plates magnetically blows the arc drawn between said separable contacts.

8. Current limiting device according to claim 6, having an arc chute means adjacent to said plates.

* * * * *